US006694093B2

(12) United States Patent
Morris et al.

(10) Patent No.: US 6,694,093 B2
(45) Date of Patent: Feb. 17, 2004

(54) ANTIFREEZE SYSTEM FOR INSTANT WATER HEATERS

(75) Inventors: Donald E. Morris, Laguna Beach, CA (US); Robert L. Wheeler, Monrovia, CA (US)

(73) Assignee: Acorn Engineering Co., Inc., City of Industry, CA (US)

( * ) Notice: Subject to any disclaimer, the term of this patent is extended or adjusted under 35 U.S.C. 154(b) by 120 days.

(21) Appl. No.: 10/052,369

(22) Filed: Jan. 25, 2002

(65) Prior Publication Data

US 2003/0142967 A1 Jul. 31, 2003

(51) Int. Cl.[7] ..... F24H 1/10
(52) U.S. Cl. ..... 392/479; 219/523
(58) Field of Search ..... 392/479, 468; 219/523, 524, 535

(56) References Cited

U.S. PATENT DOCUMENTS

| | | | | | |
|---|---|---|---|---|---|
| 3,657,517 | A | * | 4/1972 | Hoyt | 219/535 |
| 4,558,206 | A | * | 12/1985 | Ball | 392/468 |
| RE33,523 | E | * | 1/1991 | Devine | 137/341 |
| 5,614,119 | A | * | 3/1997 | Ollis | 219/385 |
| 6,021,804 | A | * | 2/2000 | Griffin et al. | 137/341 |
| 6,058,718 | A | * | 5/2000 | Forsberg et al. | 62/125 |

* cited by examiner

*Primary Examiner*—Thor Campbell
(74) *Attorney, Agent, or Firm*—Edgar W. Averill, Jr.

(57) ABSTRACT

An antifreeze heating system which prevents the freezing of water present in an instant water heater of the type having a primary heater which remains inactive under static flow conditions. A secondary heater is placed within an enclosed housing volume of the instant water heater, and electrically connected to a temperature-sensitive switch which activates the secondary heater when a monitored temperature, such as the ambient temperature, falls below a threshold value.

20 Claims, 2 Drawing Sheets

ANTIFREEZE SYSTEM FOR INSTANT WATER HEATERS

BACKGROUND OF THE INVENTION

The field of the invention generally pertains to heaters and heating systems. The invention relates more particularly to a secondary heating system which prevents the freezing of static water present in an instant water heater, wherein a temperature-sensitive switch monitors the temperature of a designated area or space and activates a secondary heating element when the monitored temperature falls below a threshold level.

Various types of water heating systems have been developed to provide hot running water in homes, commercial buildings, and the like. One notable innovation in water heating has been the advent of instant water heaters which heat water on demand independent of a centralized water heating system. Such instant water heaters are typically small, electrically operated, and self-contained units which are interposed in water lines near the spout ends, e.g. a faucet. Because of the close proximity between the instant water heater and the spout end, conductive heat loss through the piping is substantially reduced. Moreover, because the primary heating unit of an instant water heater is typically activated only during flow conditions, i.e. when a valve is opened at a spout end, energy is conserved when not in use. One example of an instant water heater of this type is marketed under the trademark, "Hotman" by Acorn Engineering in Chino, Calif.

However, it has been observed that when used in cold climates, the water remaining in a conduit portion (see 22 in FIG. 1) of such instant water heaters can freeze when the temperature falls to freezing levels. Although the conduit portion is sheltered within the housing, it is typically not additionally insulated, as is commonly provided for traditional hot water lines. Moreover, because the housing body is typically constructed from a metallic material, such as aluminum, the inner housing temperature can quickly reach levels of the outside ambient air. It is also appreciated that while continuous operation of the primary heating unit alone would prevent freezing, the high efficiency and energy cost savings provided by an "on-demand" heating system would be lost.

Thus, it would be advantageous to provide a low-power secondary heating system which prevents water remaining in the instant water heater from freezing under static, no-flow conditions. Moreover, it would be beneficial to automate activation of the secondary heating system by monitoring the temperature of a designated area or space, and activating the secondary heating unit when the monitored temperature falls below a threshold level. In this manner, the instant water heater would be available for service at all times, and under all temperatures and climates, while minimizing energy consumption.

BRIEF SUMMARY OF THE INVENTION

It is an object of the present invention to provide a simple secondary heating system which is utilized in conjunction with an instant water heater of the type having a primary heater which is activated only during flow conditions, with the secondary heating system preventing water within the instant water heater from freezing during static flow conditions.

It is a further object of the present invention to provide an automated secondary heating system which monitors the temperature of a designated area or space, such as the ambient temperature outside of the instant water heater, and activates a secondary heating unit when the monitored temperature falls below a threshold value.

A still further object of the present invention is to provide an efficient, low-power secondary heating system which requires substantially less energy than the primary heater of the instant water heater.

It is a still further object of the present invention to provide a secondary heating system which comprises a simple electrical circuit utilizing common electrical components, for facilitating manufacture and assembly.

The present invention is for an antifreeze system for use with an instant water heater of the type having a housing body which encloses a housing volume, a water conduit mounted within the housing volume with an inlet and an outlet, and primary heater means for heating water in the water conduit when water flows therethrough from the inlet to the outlet. In a first preferred embodiment, the antifreeze system comprises secondary heater means for heating the housing volume to prevent water from freezing in the water conduit, and a temperature-sensitive switch operatively connected to the secondary heater means, for switching on the secondary heater means when a monitored temperature falls below a threshold value. And in a second preferred embodiment, the antifreeze system comprises secondary heater means positioned within the housing volume for heating the water conduit to prevent water from freezing therein, and a temperature-sensitive switch discussed above.

Furthermore, the present invention is for an improved instant water heater having a housing body which encloses a housing volume, a water conduit mounted within the housing volume with an inlet and an outlet, primary heater means for heating water in the water conduit when water flows therethrough from the inlet to the outlet, secondary heater means for preventing water from freezing within the water conduit, and a temperature-sensitive switch operatively connected to the secondary heater means, for switching on the secondary heater means when a monitored temperature falls below a threshold value.

DESCRIPTION OF THE PREFERRED EMBODIMENTS

Figure 6:
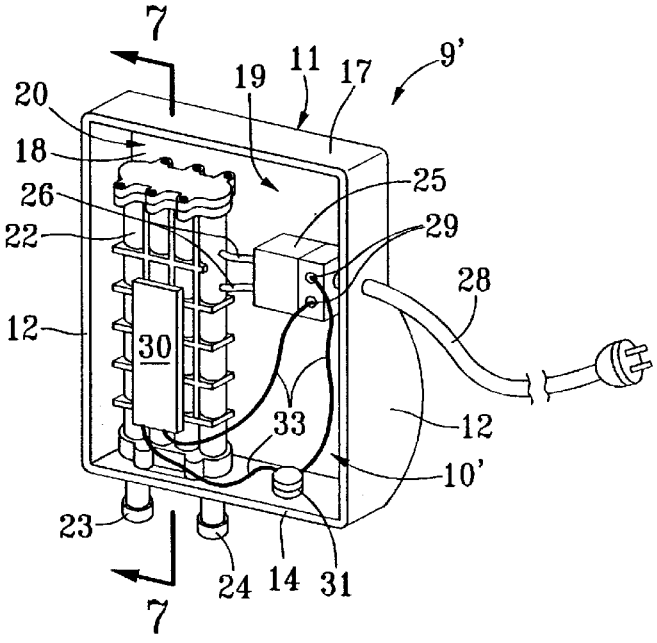
FIG. 6 is a rear perspective view of the instant water heater incorporating a second preferred embodiment of the antifreeze system of the present invention.
Figure 7:
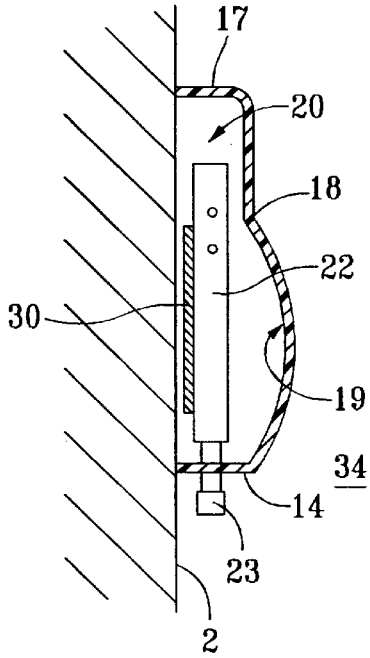
FIG. 7 is a cross-sectional side view taken along line 7—7 of FIG. 1.

Referring now to the drawings, FIGS. 1–5 show an instant water heater, generally indicated at reference character 9, and incorporating a first preferred embodiment of an ancillary antifreeze or secondary heater system, generally indicated at reference character 10. And FIGS. 6–7 show the same instant water heater 9 incorporating a second preferred embodiment of the ancillary antifreeze or secondary heater system, generally indicated at reference character 10'.

Figure 2:
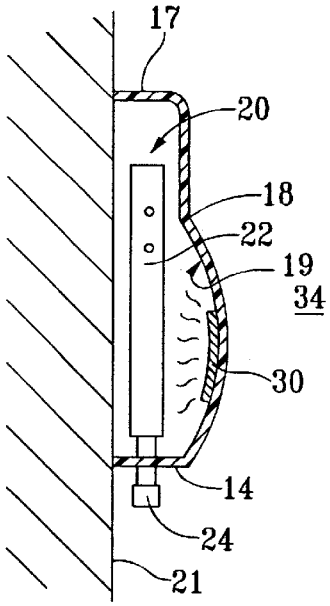
FIG. 2 is a cross-sectional side view taken along line 2—2 of FIG. 1.

The instant water heater 9 is of the type having a rigid housing body 11 with a metallic construction, such as aluminum. And the housing body 11 is shown having an open-sided configuration with a front wall 18, a pair of side walls 12, a top wall 17 and a bottom wall 14, which together define and enclose a housing volume 20. As shown in FIGS. 2 and 7, the open side of the housing body 11 is positioned adjacent a mounting wall 21 to fully enclose the housing volume 20. Though not shown in the figures, the housing body 11 and the instant water heater 9 may be suitably mounted to the mounting wall 21, e.g. by screw or bolt type fasteners. While a back wall is not shown, it is appreciated that one may also be provided and positioned opposite the front wall 18 to form a housing body which fully encloses the housing volume without the mounting wall.

Figure 1:
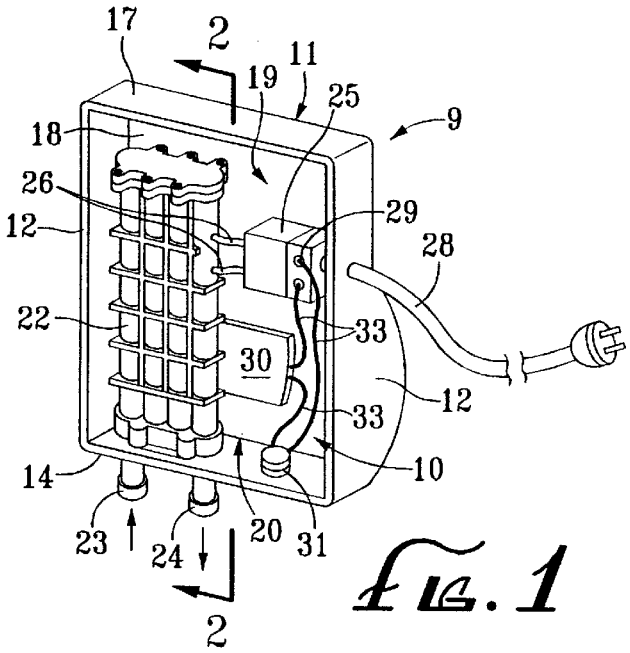
FIG. 1 is a rear perspective view of the instant water heater incorporating a first preferred embodiment of the antifreeze system of the present invention.

Furthermore, the instant water heater 9 includes a water conduit 22 which is suitably mounted within the housing volume 20 of the housing body 11. The water conduit 22 functions to lead water into and out of the housing body 11 where heating takes place, as will be discussed below. As can be seen in FIGS. 1 and 2, the water conduit 22 has an inlet 23 and an outlet 24 which extend through the bottom wall 14. The inlet 23 is suitably adapted to connect to a water line (not shown) which delivers water from a water source. And the outlet 24 is also suitably adapted to connect to a hose, pipe, or other water conduit leading to a spout end (not shown). It is understood that the term "spout end" as used herein and in the claims indicates any point from which the transported hot water may be received and used. Examples of spout ends include, but are not limited to, a faucet, shower head, washing machine, etc.

Connected to the water conduit 22 is a primary heater, which typically includes a heater control unit 25 electrically connected to an energy source, e.g. a standard wall outlet (not shown), via an electric cord 28. In FIGS. 1 and 6, the heater control unit 25 is shown having connector wires 26 leading into the water conduit 22, where they connect to a thermogenerator, i.e. a heat generating element or device. Though not shown in the drawings, the thermogenerator is typically a series of heater coils which surround a flow path through the water conduit 22. It is appreciated that the heater coils may be formed as an integrated component of the water conduit construction 11, or separately attached as an independent component, as dictated by the particular design of the instant water heater. Moreover, it is also appreciated that the heater control unit 25 has suitable means for detecting flow conditions in the flow path through the water conduit 22, and activating and deactivating the primary heater accordingly. In this manner, the primary heater is turned on when water flows through the water conduit 22, and shuts off when flow conditions cease, e.g. when a faucet valve is closed at the faucet end.

As can be best seen in FIG. 1, the first preferred embodiment of the antifreeze system 10 is positioned within the housing volume 20 of the housing body 11. Generally, the antifreeze system 10 includes a secondary heat generating element or device 30, i.e. the secondary heater, and a temperature-sensitive switch 31 which operates to activate or deactivate the secondary heater 30. As shown in FIG. 1, the secondary heater 30 and the temperature-sensitive switch 31 are electrically connected to an energy source by circuit wires 33 to form an electric circuit. Preferably, the secondary heater 30 shares the same energy source as the primary heater via the electric cord 28. Thus, as illustrated in FIG. 1, electrical contacts 29 may be provided on the heater control unit 25 of the primary heater to which the circuit wires 33 are connected.

Figure 3:
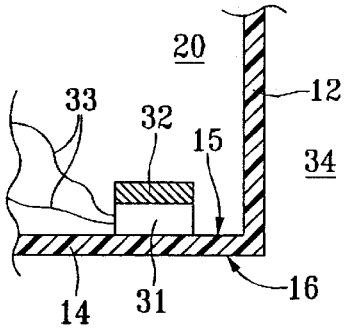
FIG. 3 is an enlarged rear elevational view of a first preferred mounting arrangement of the temperature-sensitive switch.
Figure 4:
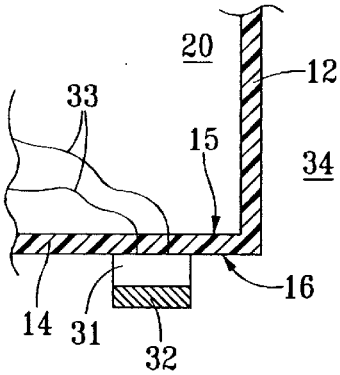
FIG. 4 is an enlarged rear elevational view of a second preferred mounting arrangement of the temperature-sensitive switch.

As can be seen in FIG. 3, the switch 31 is mounted on an inner surface 15 of the bottom wall 14, with the sensor element 32 positioned away from the inner surface 15. This arrangement provides monitoring of a housing volume temperature. And as can be seen in FIG. 4, the switch 31 is mounted on an outer surface 16 of the bottom wall 14, with the sensor element 32 positioned away from the outer surface 16. This arrangement provides monitoring of the ambient temperature outside of the housing body 11 of the instant water heater 9. And finally, in FIG. 5, the switch is mounted on bottom wall 14 such that the sensor element 32 contacts the inner surface 15 of the bottom wall 14, and the monitored temperature is that of the housing body 11. Based on fundamental principles of heat transfer, it is appreciated that the arrangement shown in FIG. 4 would provide the earliest detection of freeze temperatures, while the arrangement of FIG. 3 would provide the latest detection. This is due to the intermediate location of each of the mediums between the water conduit and external conditions. It follows therefore based on the same heat transfer principles, that monitoring the temperature of any one of these three mediums, which are external to the water conduit, provides an earlier detection of an environmental temperature change than monitoring the temperature of the water directly.

Additionally, FIGS. 1 and 2 illustrate a first preferred mounting position of the secondary heater 30, i.e. heating pad, to heat the housing volume 20. It is appreciated that heating of the housing volume 20 effectively functions to prevent freezing of water remaining within the water conduit 22 based on fundamental heat transfer principles. As shown, the heating pad 30 is contactedly attached, e.g. adhered, to an inner surface 19 of the front wall 18 which is adjacent the water conduit 22. This arrangement heats the housing volume 20 by way of transferring heat to the housing body 11, as well as by direct heating of the housing volume 20 via boundary layer heat conduction. It is appreciated, however, that the heating pad 30 or other heat generating element may be generally positioned anywhere within the housing volume 20, as well as beyond the housing body 11, in order to keep the water conduit 22 from freezing.

Figure 5:
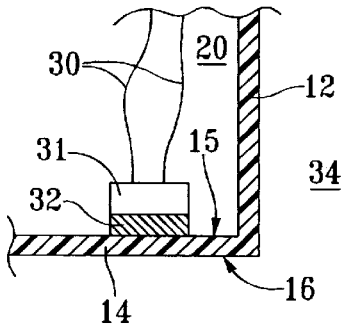
FIG. 5 is an enlarged rear elevational view of a third preferred mounting arrangement of the temperature-sensitive switch.

FIGS. 3–5 show three different embodiments of the system 10 where the temperature-sensitive switch, generally indicated at reference character 31, is positioned to monitor a designated area, space, or object. It is appreciated that the switch 31 is of a type commonly known in the electrical and electronic arts. Switch 31 may be adjustable to turn on the heating pat at a preset combustion, such as 40° F. Alternatively, a manual on/of switch may be used in place of the temperature sensitive switch. As shown in the figures, the temperature-sensitive switch 31 has a sensor element 32 where the temperature is preferably actually monitored, and is connected to the circuit wires 33 of the antifreeze system circuit. Furthermore, the switch 31 is adapted to close the circuit and activate the heat generating element 30, upon the sensor element 32 of the temperature-sensitive switch 31 detecting that a monitored temperature has fallen below a predetermined threshold value. It is appreciated that the threshold value may be assigned based on the application of fundamental heat transfer principles to the design parameters of an instant water heater.

As can be seen in FIG. 3, the switch 31 is mounted on an inner surface 15 of the bottom wall 14, with the sensor element 32 positioned away from the inner surface 15. This arrangement provides monitoring of a housing volume temperature. And as can be seen in FIG. 4, the switch 31 is mounted on an outer surface 16 of the bottom wall 14, with the sensor element 32 positioned away from the outer surface 16. This arrangement provides monitoring of the ambient temperature outside of the housing body 11 of the instant water heater 9. And finally, in FIG. 5, the switch is mounted on bottom wall 14 such that the sensor element 32 contacts the inner surface 15 of the bottom wall 14, and the monitored temperature is that of the housing body 11. Based on fundamental principles of heat transfer, it is appreciated that the arrangement shown in FIG. 4 would provide the earliest detection of freeze temperatures, while the arrangement of FIG. 3 would provide the latest detection.

It is notable that while the switch 31 is shown mounted on the bottom wall 14, it is not limited only to such. Any of the front, top, bottom, or side walls would serve to provide a suitable mounting location for the switch 31, and particularly the sensor element 32. It is further notable that the switch 31 may be suitably mounted to the housing body 11 or other structure of the instant water heater 9 by conventional fasteners, such as mounting screws (not shown).

As can be seen in FIGS. 6 an 7 the second preferred embodiment of the antifreeze system 10' is shown positioned within the housing volume 20 of the housing body 11 for heating the water conduit 22 to prevent water from freezing therein. Generally, the second preferred embodiment comprises the same components as the first preferred embodiment, including: a secondary heater 30, and a temperature-sensitive switch 31, which are electrically connected by circuit wires 33 to form an electric circuit. However, the second preferred embodiment has the secondary heater 30, e.g. the heating pad, which is preferably mounted directly to the water conduit 22 for heating the water conduit 22 directly. As illustrated, the heating pad 30 is contactedly attached, e.g. adhered, to the water conduit 22 to heat the water conduit 22 directly. It is appreciated that direct heat conduction may provide faster heating of the water conduit 22 than boundary layer heat conduction to the housing volume 20 as discussed above.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An antifreeze system for use with an instant water heater of the type having a housing body which encloses a housing volume, a water conduit mounted within the housing volume with an inlet and an outlet, and primary heater means for heating water in the water conduit when water flows therethrough from the inlet to the outlet, said antifreeze system comprising:

secondary heater means for heating the housing volume to prevent water from freezing in the water conduit; and a temperature-sensitive switch operatively connected to the secondary heater means for monitoring the temperature of a medium external to the water conduit and thus affected by environmental temperature changes earlier than the water, and for switching on the secondary heater means when the monitored temperature falls below a threshold value.

2. An antifreeze system for use with an instant water heater of the type having a housing body which encloses a housing volume, a water conduit mounted within the housing volume with an inlet and an outlet, and primary heater means for heating water in the water conduit when water flows therethrough from the inlet to the outlet, said antifreeze system comprising:

secondary heater means for heating the housing volume to prevent water from freezing in the water conduit, wherein the secondary heater means contacts the housing body to conduct heat thereto, whereby the housing volume is heated at least in part via the housing body; and a temperature-sensitive switch operatively connected to the secondary heater means for switching on the secondary heater means when a monitored temperature falls below a threshold value.

3. The antifreeze system as in claim 2, wherein the secondary heater means is attached to an inner surface of the housing body, whereby the housing volume is heated at least in part by boundary layer conduction from the secondary heater means.

4. The antifreeze system as in claim 3, wherein the secondary heater means is a resistance heating pad attached to the inner surface of the housing body.

5. The antifreeze system as in claim 1, wherein the monitored temperature is an ambient temperature beyond the housing body, and a sensor element of the temperature-sensitive switch is positioned beyond the housing body to monitor the ambient temperature.

6. The antifreeze system as in claim 1, wherein the monitored temperature is a housing volume temperature of the housing volume, and a sensor element of the temperature-sensitive switch is positioned within the housing volume to monitor the housing volume temperature.

7. The antifreeze system as in claim 1, wherein the monitored temperature is a housing body temperature of the housing body, and a sensor element of the temperature-sensitive switch contacts the housing body to monitor the housing body temperature.

8. An antifreeze system for use with an instant water heater of the type having a housing body which encloses a housing volume, a water conduit mounted within the housing volume and having an inlet and an outlet, and primary heater means for heating water in the water conduit when water flows therethrough from the inlet to the outlet, said antifreeze system comprising:

secondary heater means positioned within the housing volume for heating the water conduit to prevent water from freezing therein; and a temperature-sensitive switch operatively connected to the secondary heater means, for monitoring the temperature of a medium external to the water conduit and thus affected by environmental temperature changes earlier than the water, and for switching on the secondary heater means when the monitored temperature falls below a threshold value.

9. The antifreeze system as in claim 8, wherein the secondary heater means contacts the water conduit to conduct heat thereto.

10. The antifreeze system as in claim 9, wherein the secondary heater means is a resistance heating pad attached to the water conduit.

11. The antifreeze system as in claim 8, wherein the monitored temperature is an ambient temperature beyond the housing body, and a sensor element of the temperature-sensitive switch is positioned beyond the housing body to monitor the ambient temperature.

12. The antifreeze system as in claim 8, wherein the monitored temperature is a housing volume temperature of the housing volume, and a sensor element of the temperature-sensitive switch is positioned within the housing volume to monitor the housing volume temperature.

13. The antifreeze system as in claim 8, wherein the monitored temperature is a housing body temperature of the housing body, and a sensor element of the temperature-sensitive switch contacts the housing body to monitor the housing body temperature.

14. An improved instant water heater comprising:

a housing body which encloses a housing volume;

a water conduit mounted within the housing volume with an inlet and an outlet;

primary heater means for heating water in the water conduit when water flows therethrough from the inlet to the outlet;

secondary heater means for preventing water from freezing within the water conduit; and a temperature-sensitive switch operatively connected to the secondary heater means for monitoring the temperature of a medium external to the water conduit and thus affected by environmental temperature changes earlier than the water, and for switching on the secondary heater means when a the monitored temperature falls below a threshold value.

15. The improved instant water heater as in claim 14, wherein the secondary heater means contacts the water conduit to conduct heat directly thereto.

16. The improved instant water heater as in claim 15, wherein the secondary heater means is a resistance heating pad attached to the water conduit.

17. An improved instant water heater comprising:

a housing body which encloses a housing volume;

a water conduit mounted within the housing volume with an inlet and an outlet;

primary heater means for heating water in the water conduit when water flows therethrough from the inlet to the outlet;

secondary heater means for preventing water from freezing within the water conduit, wherein the secondary heater means contacts the housing body to conduct heat thereto, whereby the housing volume is heated at least in part via the housing body; and a temperature-sensitive switch operatively connected to the secondary heater means, for switching on the secondary heater means when a monitored temperature falls below a threshold value.

18. The improved instant water heater as in claim 17, wherein the secondary heater means is attached to an inner surface of the housing body, whereby the housing volume is heated at least in part by boundary layer conduction from the secondary heater means.

19. The improved instant water heater as in claim 18, wherein the secondary heater means is a resistance heating pad attached to the inner surface of the housing body.

20. The antifreeze system as in claim 8, wherein said threshold value is adjustable.

* * * * *